United States Patent [19]

Kohayakawa et al.

[11] Patent Number: 4,826,409

[45] Date of Patent: May 2, 1989

[54] CLOSED TYPE ROTARY COMPRESSOR WITH ROTATING MEMBER TO PREVENT BACK PRESSURE ON DISCHARGE VALVE

[75] Inventors: Hirokazu Kohayakawa; Takuho Hirahara; Takashi Yamamoto, all of Shizuoka, Japan

[73] Assignee: Mitsubishi Denki Kabushiki Kaisha, Tokyo, Japan

[21] Appl. No.: 165,848

[22] Filed: Mar. 9, 1988

[30] Foreign Application Priority Data

Mar. 9, 1987 [JP] Japan ..... 62-53603

[51] Int. Cl.[4] ..... F04C 18/356; F04C 29/08

[52] U.S. Cl. ..... 418/63; 418/270

[58] Field of Search ..... 418/151, 63, 270; 417/410, 456, 510, 902; 137/614.2

[56] References Cited

U.S. PATENT DOCUMENTS

| | | | |
|---|---|---|---|
| 4,427,351 | 1/1984 | Sano | 418/63 |
| 4,580,956 | 4/1986 | Takahashi et al. | 418/151 X |
| 4,628,963 | 12/1986 | Ishijima et al. | 137/857 |

FOREIGN PATENT DOCUMENTS

| | | | |
|---|---|---|---|
| 51-43204 | 11/1976 | Japan . | |
| 0131395 | 8/1983 | Japan | 418/270 |
| 0029790 | 2/1987 | Japan | 418/63 |

OTHER PUBLICATIONS

Keiju Sakaino et al, Some Approaches Towards a High Efficient Rotary Compressor, pp. 315-322.

*Primary Examiner*—Carlton R. Croyle
*Assistant Examiner*—Leonard P. Walnoha
*Attorney, Agent, or Firm*—Oblon, Fisher, Spivak, McClelland & Maier

[57] ABSTRACT

A closed type rotary compressor comprises: a closed housing, a driving electric motor housed in the housing and having a rotor rotating together with a rotary shaft, an upper bearing wall and a lower bearing wall housed in the housing for supporting the respective ends of the rotary shaft, a cylinder fixed between the upper and lower bearing walls and having a compression chamber therein, a rolling piston arranged in the compression chamber and eccentrically rotating together with the rotary shaft, and a rotating member arranged between the rotor and the upper bearing wall and rotating together with the rotor, wherein the cylinder is provided with an intake passage for feeding a refrigerant gas into the compression chamber, and a valve chamber for discharging the refrigerant gas through a discharge valve, the valve communicating a discharge passage formed in the upper bearing wall, and wherein the rotor is provided with a wider portion for covering an opening of the passage in the upper bearing wall and a narrower portion for exposing the opening, the mounting angle of the rotating member to the rotor and the eccentricity of the rolling piston to the rotary shaft are determined so that the wider portion keeps covering the opening until the discharge valve starts opening.

4 Claims, 6 Drawing Sheets

CLOSED TYPE ROTARY COMPRESSOR WITH ROTATING MEMBER TO PREVENT BACK PRESSURE ON DISCHARGE VALVE

The present invention relates to a closed type rotary compressor utilized in a device such as a refrigerator, an air conditioner and so on, wherein the back pressure in a valve chamber during the initial opening of refrigerant discharge valve is forced to temporarily decrease so as to obtain effective rotation.

FIGS. 6 and 7 are a longitudinal cross-sectional view and a transverse cross-sectional view showing a conventional closed type rotary compressor as disclosed in Japanese Examined Patent Publication No. 43204/1976. In the Figures, a closed housing 13 includes a cylinder 1, a compression chamber 1A formed in the cylinder 1, a rotary shaft 2 rotating in and through the cylinder 1 and having an eccentric member 3 as a unit, a rotor 17 of a driving electric motor 16 fixed on the shaft at the upper part, and an upper bearing wall 14 and a lower bearing wall 15 for supporting the shaft at the lower part. The cylinder 1 is fixed between the bearing walls 14 and 15 by means of fixtures comprising bolts and nuts. The compression chamber 1A comprises the space defined by the upper bearing wall 14, the lower bearing wall 15 and the cylinder 1. The eccentric member 3 is provided with a rolling piston 4 fitted around it, which is placed in the compression chamber 1A and rotates together with the rotary shaft 2 so as to carry out eccentric rotation The rolling piston 4 has a vane 5 which keeps in touch with the piston at its leading edge under the action of a coiled spring 6 at a predetermined pressure. The cylinder 1 has an intake passage 10 formed therethrough, which feeds a refrigerant gas into the compression chamber 1A. The cylinder also has a discharge port 11 for discharging the compressed gas from the compression chamber 1A. A cylindrical valve chamber 9 is formed in the cylinder and communicates the discharge port 11 through a discharge valve 7 and also communicates a discharge passage (not shown) formed in the upper bearing wall 14. The discharge port 11 is arranged in the cylinder so as to be in alignment with the center of the valve chamber 9 and opens towards the compression chamber 1A which is located in the direction of the center of the cylinder 1. The discharge valve 7 and a stopper 8 for restricting the movement of the discharge valve 7 are housed in the valve chamber 9. The rotor 17 is provided with a balance weight 18 attached to the lower end thereof as a unit, as shown in FIG. 6.

The operation of the conventional closed type rotary compressor having such structure will be explained. When the electric motor is driven, the rotary shaft 2 rotates to make the rolling piston 4 eccentrically rotate. As a result, a refrigerant gas is sucked from the intake passage 10 into the compression chamber 1A and is compressed in it. The compressed gas moves from the discharge port 11 into the valve chamber 9 through the discharge valve 7, leaves from the discharge passage in the upper bearing 14 and then it is discharged into the closed housing 13 through a discharge muffler 12.

As explained, since the compressed gas which is transferred from the discharge port 11 through the discharge valve 7 is discharged into the closed housing 13 through the discharge muffler 12, a discharge pressure is always applied to the discharge valve 7 on the back, which brings about overcompression due to the delay in the timing of the opening of the discharge valve 7. As a result, the conventional closed type rotary compressors have disadvantage that input power must be increased and noise becomes larger.

It will be considered what condition makes the discharge valve 7 open to establish connection between the compression chamber 1A and the valve chamber 9. The force which acts to open the discharge valve 7 is an inner pressure Ps in the compression chamber 1A, which is a pressure applied to the upstream side of the discharge valve 7. On the other hand, the force which acts to close the discharge valve 7 is equal to the sum of the elastic force Px of the discharge valve 7 and the inner pressure Pd in the valve chamber 9 as back pressure of the discharge valve 7. If the condition satisfies the following inequality, the discharge valve 7 opens:

$$Ps > Px + Pd \qquad (I)$$

In the inequality, the elastic force Px of the discharge valve 7 is predetermined by the material and the thickness of the discharged valve 7 as utilized. Whereas the pressure Ps in the compression chamber 1A which is required to move the discharge valve 7 is variable according to the back pressure Pd of the discharge valve 7.

It is an object of the present invention to provide a closed type rotary compressor wherein the back pressure of a discharge valve at the time of opening the discharge valve is reduced to make the influence by the elastic force Px of the discharge valve larger, and a valve chamber housing the discharge valve is designed to carry out smoother operation of the discharge valve.

The foregoing and the other objects of the present invention have been attained by providing a closed type rotary compressor constituted so that there is provided a rotating member comprising a wider portion and a narrower portion, and the mounting position of the rotating member to a rotor and eccentricity of a rolling piston with respect to a rotary shaft are determined so as to continue covering an opening of a discharge passage of a cylindrical valve chamber formed in an upper bearing wall, by the wider portion of the rotating member attached to the lower end surface of the rotor until the discharge valve starts opening. As a result, since the opening formed in the upper bearing wall starts being exposed just before the discharge valve opens, the back pressure of the discharge valve is temporarily decreased to the pressure in a closed housing to obtain smooth opening operation of the discharge valve.

Figure 6:
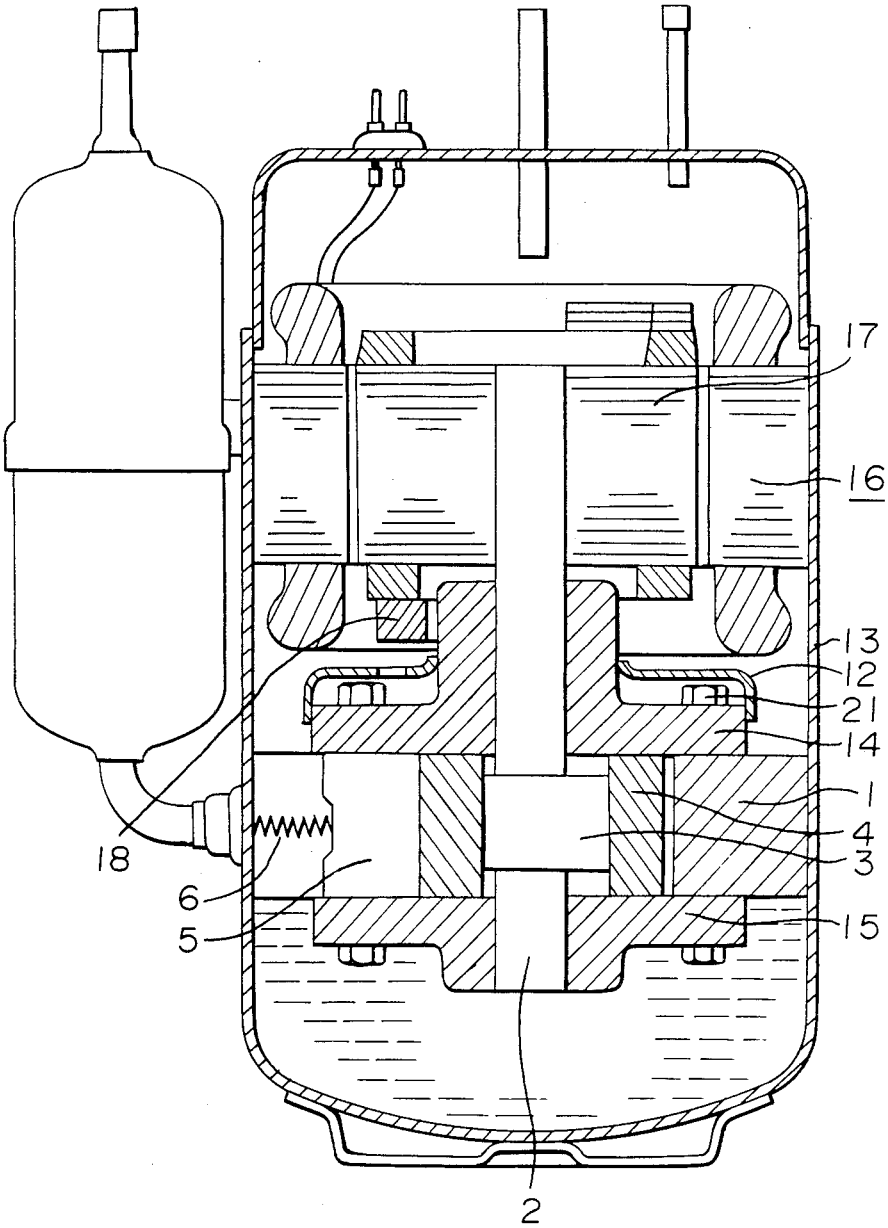
FIGURE 6 PRIOR ART
FIG. 6 is a longitudinal cross-sectional view showing a conventional rotary compressor.
Figure 7:
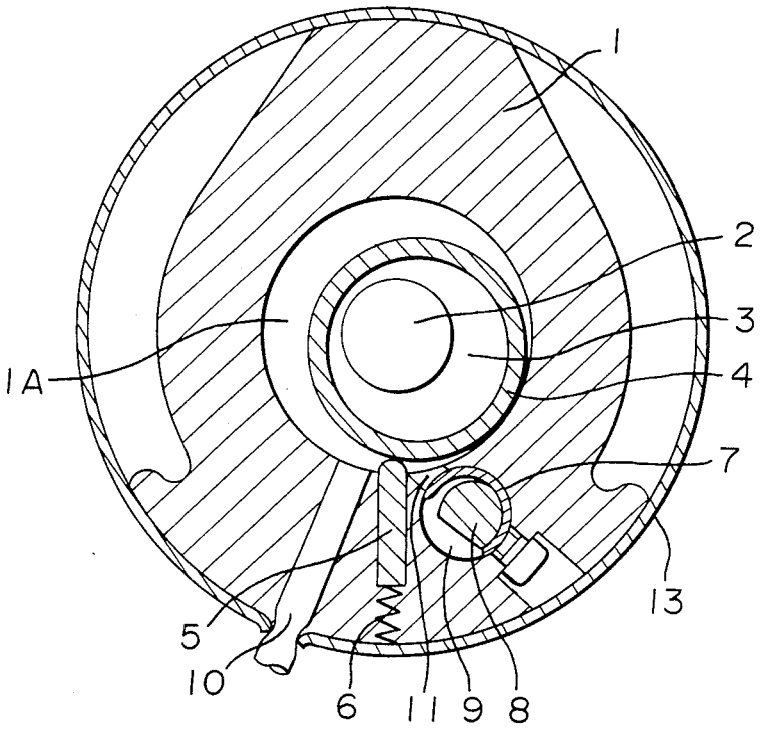
FIGURE 7 PRIOR ART
FIG. 7 is a transverse cross-sectional view showing the conventional rotary compressor.

Now, the present invention will be described in detail with reference to preferred embodiments illustrated in the accompanying drawings. In FIG. 1 through FIG. 3B, components having the same function as the components of the conventional rotary compressor as shown in FIGS. 6 and 7 are designated with the same reference numeral and the explanation about the components is omitted.

In FIGS. 1 through 3B, a closed type rotary compressor according to the present invention includes a rotating member 20 which is arranged between a rotor 17 and an upper bearing wall 14 so as to be rotatable integrally with the rotor. The rotating member 20 has a wider portion 20A and a narrower portion 20B. The wider portion 20A is formed so as to be in sliding contact with the upper bearing wall 14 and cover an opening 14B of a discharge passage 14A which is formed in the upper bearing wall 14 and communicates a valve chamber 9 in a cylinder 1. The narrower portion 20B is formed so as not to cover the opening 14A. The rotating member 20 can be constituted by a cylindrical member with a central hole for a rotary shaft 2, and a flange radially provided on a part of the circumferential wall of the cylindrical member. The circumference of the flange is concentric with the cylindrical member and projects outwardly beyond the circumference of the upper bearing wall 14. The portion of the rotating member where the flange is provided forms the wider portion 20A, and the portion of the rotating member where the flange is not provided forms the narrower portion 20B. It is preferable that the flange has opposite ends in the circumferential direction curved along the opening 14A at the connections with the cylindrical member.

In the embodiment, a balance weight 18 is arranged between the rotor 17 and the rotating member 20 so as to form one unit one another. The rotor 17, the balance weight 18 and the rotating member 20 rotate together. And the rotating member 20, the balance weight 18, the rotor 17, the shaft 2, and a rolling piston 4 fitted on and around an eccentric member 3 rotate together.

In accordance with the present invention, the mounting angle of the rotating member 20 to the rotor 17, and the eccentricity of the eccentric member 3 attributable to the eccentricity of the rolling piston 4 are determined so that the wider portion 20A of the rotating member 20 keeps covering the opening 14B in the upper bearing wall 14 until a discharge valve arranged in the valve chamber starts opening. Fixtures 23 comprising bolts and nuts for fixing the upper bearing 14, the cylinder 1 and the lower bearing wall 15 together have their top ends positioned in recesses 22 formed in the upper bearing 14 to prevent the fixtures from projecting from the surface of the upper bearing 14 with the opening 14B formed in. By this arrangement, the rotating member 20 can rotate above the upper bearing wall 14 without bumping the fixtures 23.

Figure 1:
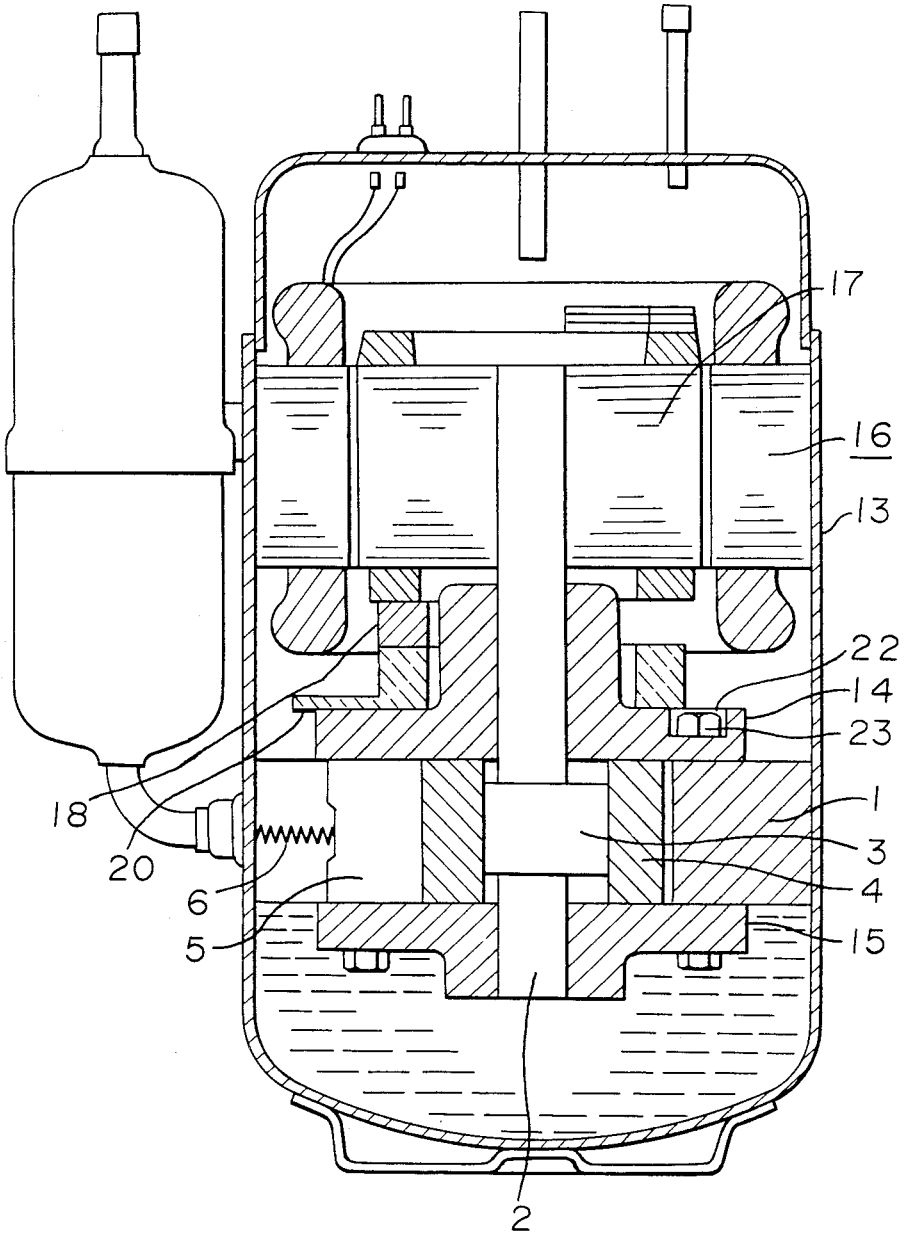
FIG. 1 is a longitudinal cross-sectional view showing an embodiment of the closed type rotary compressor according to the present invention.
Figure 2:
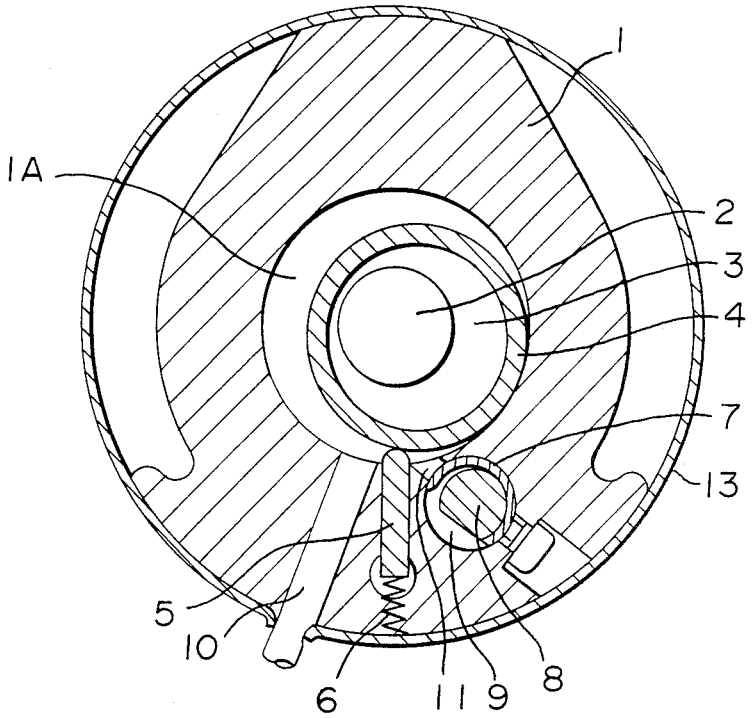
FIG. 2 is a transverse cross-sectional view showing the embodiment.
Figure 3A:
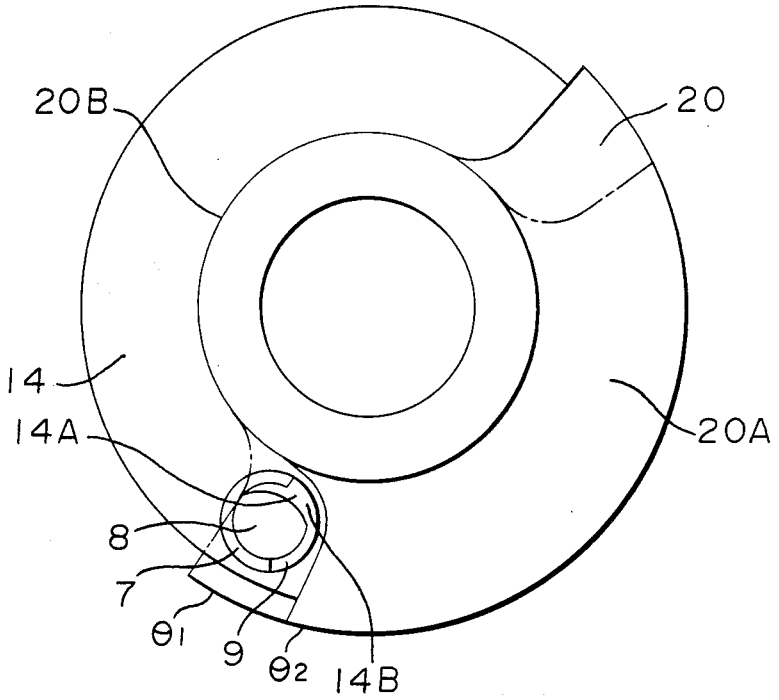
FIG. 3A is a plan view showing the essential parts for illustrating the relationship between a valve chamber and a rotary member according to present invention.
Figure 3B:
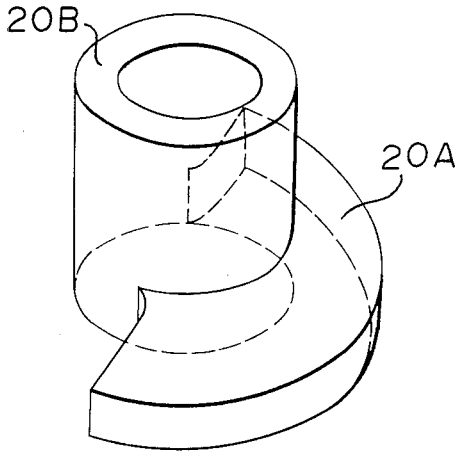
FIG. 3B is a perspective view of the rotating member.
Figure 4:
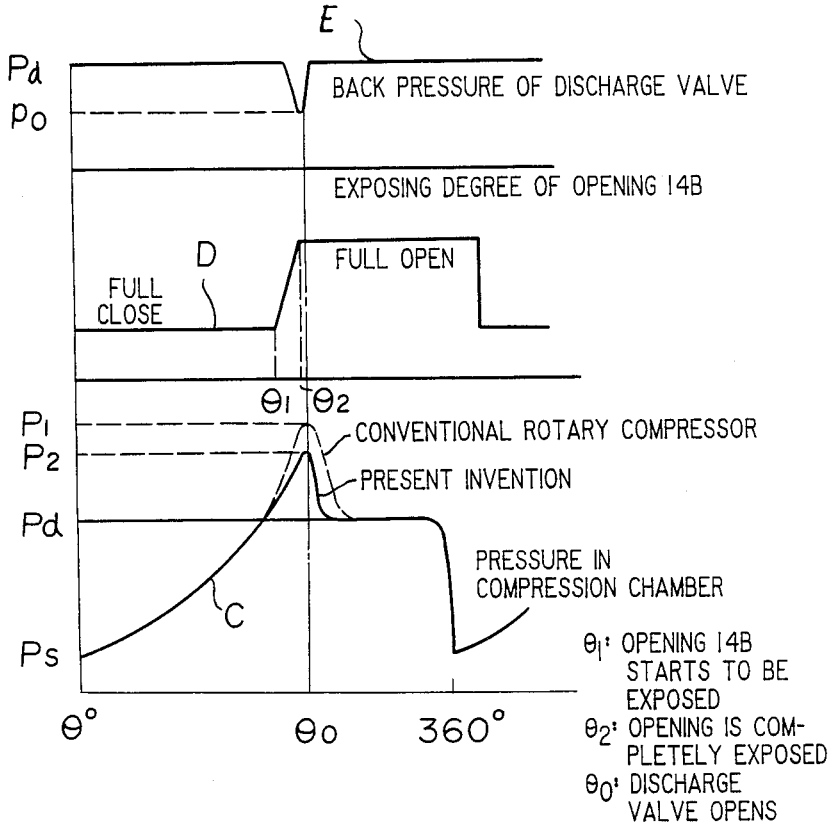
FIG. 4 is a graphical representation showing the relationship between the back pressure of a discharge valve, the pressure in a cylinder and the opening degree of a valve chamber.

The operation will be described with reference to FIGS. 3A and 3B showing the rotating member 20 and FIG. 4 showing pressure conditions.

When the compressor is driven, the rotary shaft 2 is rotated to turn the rolling piston 4 eccentrically. As a result, a refrigerant gas sucked from an intake passage 10 formed in the cylinder 1 into a compression chamber 1A is compressed therein and the internal pressure in the compression chamber 1A raises as indicated by a curve C in FIG. 4. In the conventional rotary compressor, there is no connection between the compression chamber 1A and the valve chamber 9 due to the elastic pressure by the discharge valve 7 until the pressure in the compression chamber 1A countering the back pressure Pd reaches a pressure $P_1$ because the back pressure of the discharge valve 7 maintains at Pd. In accordance with the present invention, the opening 14B communicating the valve chamber 9 has been being covered by the wider portion 20A of the rotating member 20 as indicated by a dotted line in FIG. 3A until the eccentric rolling piston 4 rotates to reach a position $\theta_1$ which is just before a position $\theta_O$ where the pressure in the compressor chamber 1A is increased to open the discharge valve. When the rotating member 20 rotates to be at the position $\theta_1$, the narrower portion 20B of the rotating member 20 comes above the opening 14B to cease the closure of the opening by the rotating member 20. As the rotating member 20 rotates from the position $\theta_1$ to a position $\theta_2$, the exposure of the opening 14B becomes greater as indicated a curve D in FIG. 4. When the rotating member rotates to reach the position indicated by $\theta_2$, the opening 14B becomes full open as indicated by a solid line in FIG. 3A. When the rotating member 20, in particular the wider portion 20A passes over the opening 14B in the upper bearing wall 14 and starts to expose it, the gas in the opening 14B communicating the valve chamber 9 suddenly goes out of there to temporarily decrease the inner pressure in the valve chamber 9 as the back pressure of the discharge valve 7 to Po as indicated by a curve E in FIG. 4.

As explained, the back pressure of the discharge valve 7 is decreased to Po though the back pressure in the conventional rotary compressor is Pd that is higher than Po. Although the conventional rotary compressor requires a pressure $P_1$ in the compression chamber 1A as the upstream pressure of the discharge valve 7 in order to allow the discharge valve 7 to open against the elastic resistance and the back pressure of the discharge valve, the rotary compressor according to the present invention enables the discharge valve 7 to open at a pressure $P_2$ that is lower than the pressure $P_1$, and the refrigerant gas in the compression chamber 1A is discharged from the valve chamber 9 through the opened discharge valve.

The present invention is capable of decreasing by the rotating member 20 the back pressure of the discharge valve 7 which is effective to the movement of the discharge valve 7, smoothening the opening operation of the discharge valve 7, reducing the input power by restraining the increase in pressure in the cylinder, and restraining the increase in pressure in the cylinder, i.e. overcompression, which can minimize noise.

Although in the embodiment the balance weight 18 is put on and attached to the separate rotating member 20, it is possible to give the function of a balance weight to the rotating member 20 itself, or to give the function of a rotating member to the balance weight itself.

Figure 5:
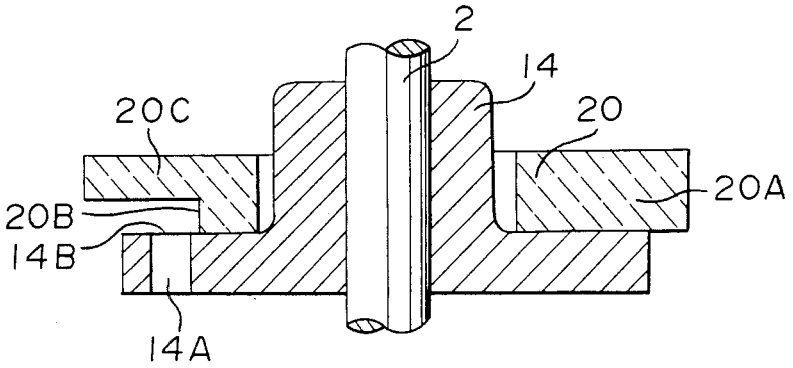
FIG. 5 is a longitudinal cross-sectional view showing the rotating member according to another embodiment.

Another embodiment of the rotating member 20 will be explained with respect to FIG. 5. In the embodiment, the upper part of the narrower portion 20B is extended outwardly to form a hood 20C. The provision of the hood 20C facilitates adjustment of the balance by modifying the length, thickness or similar factor of the hood 20C.

Since the closed type rotary compressor according to the present invention is constituted as above-mentioned, the pressure in the valve chamber, i.e. the back pressure of the discharge valve can be temporarily decreased just before the discharge valve opens, and the overcompression can be restrained accordingly. As a results, it is possible to decrease the input power and minimize any noise to obtain a highly effective closed type rotary compressor.

We claim:

1. A closed type rotary compressor comprising:

a closed housing, a driving electric motor housed in the housing and having a rotor rotating together with a rotary shaft, an upper bearing wall and a lower bearing wall housed in the housing for supporting the respective ends of the rotary shaft, a cylinder fixed between the upper and lower bearing walls and having a compression chamber therein, a rolling piston arranged in the compression chamber and eccentrically rotating together with the rotary shaft, and a rotating member arranged between the rotor and the upper bearing wall and rotating together with the rotor, wherein the cylinder is provided with an intake passage for feeding a refrigerant gas into the compression chamber, and a valve chamber for discharging the refrigerant gas through a discharge valve, the valve communicating a discharge passage formed in the upper bearing wall, and wherein the rotating member is provided with a wider portion for covering an opening of the passage in the upper bearing wall and a narrower portion for exposing the opening, the mounting angle of the rotating member to the rotor and the eccentricity of the rolling piston to the rotary shaft are determined so that the wider portion keeps covering the opening until the discharge valve starts opening.

2. A rotary compressor according to claim 1, wherein a fixture for fixing the cylinder between the upper and the lower bearing walls is positioned so as not to project from the surface of the upper bearing wall with the opening formed therein.

3. A rotary compressor according to claim 2, wherein there is provided a recess in the surface of the upper bearing wall with the opening formed therein so as to prevent the fixture from projecting from the surface.

4. A rotary compressor according to claim 3, wherein the fixture comprises a bolt and a nut.

* * * * *